US005601402A

United States Patent [19]

Wakeman et al.

[11] Patent Number: 5,601,402

[45] Date of Patent: Feb. 11, 1997

[54] TURBO MACHINE SHROUD-TO-ROTOR BLADE DYNAMIC CLEARANCE CONTROL

[75] Inventors: Thomas G. Wakeman, Lawrenceburg, Ind.; Robert J. Corsmeier, Cincinnati, Ohio

[73] Assignee: The United States of America as represented by the Secretary of the Air Force, Washington, D.C.

[21] Appl. No.: 874,201

[22] Filed: Jun. 6, 1986

[51] Int. Cl.[6] ..... F01D 11/08

[52] U.S. Cl. ..... 415/173.2; 415/173.1; 415/47

[58] Field of Search ..... 415/113, 116, 415/171, 174, 178, 170 R, 170 B, 173 R, 170.1, 173.1, 174.1–174.5, 178, 171.1, 47, 173.2; 60/39.32, 223

[56] References Cited

U.S. PATENT DOCUMENTS

| | | | |
|---|---|---|---|
| 3,085,398 | 4/1963 | Ingleson | 60/39.32 |
| 3,391,904 | 7/1968 | Albert et al. | 253/77 |
| 3,966,354 | 6/1976 | Patterson | 415/116 |
| 3,975,901 | 8/1976 | Hallinger et al. | 60/39.14 |
| 3,982,850 | 9/1976 | Jenkinson | 415/178 |
| 4,247,247 | 1/1981 | Thebert | 415/113 |
| 4,679,981 | 7/1987 | Guibert et al. | 415/116 |
| 4,696,619 | 9/1987 | Lardellier | 60/39.32 |
| 4,804,310 | 2/1989 | Fuller et al. | 415/116 |

*Primary Examiner*—Michael Carone

*Attorney, Agent, or Firm*—Gina S. Tollefson; Thomas L. Kundert; Gerald B. Hollins

[57] ABSTRACT

A clearance control arrangement for the rotor blade-to-stator shroud clearance in an aircraft engine or other turbo machine. The disclosed arrangements use large area piston-like structures located circumferential to the turbo machine and capable of operation from pressures developed within the machine. One disclosed arrangement incorporates static adjustment capability that can be disposed to provide symmetrical or asymmetrical clearances. The disclosed clearance control can be used as a fast-acting supplement or in lieu of other clearance control arrangements and is arranged to be actuated upon sensing the onset of rotor-to-stator collision pinch point conditions in the turbo machine.

33 Claims, 5 Drawing Sheets

Fig. 1 PRIOR ART (U)

TURBO MACHINE SHROUD-TO-ROTOR BLADE DYNAMIC CLEARANCE CONTROL

RIGHTS OF THE GOVERNMENT

The invention described herein may be manufactured used by or for the Government of the United States for all governmental purposes without the payment of any royalty.

BACKGROUND OF THE INVENTION

This invention relates to the field of turbine machinery such as jet aircraft engines and to the maintenance of close operating clearances between rotor and stator portions of such machinery.

The use of position adjustable shroud structures around the periphery of a bladed or bucketed turbine rotor to control the rotor-to-stator running clearance and thereby limit the flow of leakage gases between the rotor bucket ends and the stator has become accepted practice in aircraft jet engines and other turbo-machines. The need for this adjustable shroud usually arises from dimensional changes in the turbo machine elements—as a result of temperature changes incurred between static and operating conditions of the turbo machine. In the aircraft jet engine, for example, a significant increase in rotor diameter is often experienced between the cold engine stationary condition and the hot engine operating condition. Without the employment of movable shroud apparatus, the accommodation of this rotor dimensional change would require an undesirably large rotor-to-stator clearance when the engine is in the cold or below steady-state operating condition in order that desirable, low loss clearances be achieved during engine steady-state conditions.

The maintenance of desirable rotor-to-stator clearance in a turbo machine is, however, hampered by the occurrence of stator structure dimensional changes—also a result of temperature changes and environmental changes. Ideally, of course, the growth of rotor and stator members could be called upon to track or compensate one for the other, however, differing thermal time constants and mechanical stiffness between rotor and stator members preclude reliance on such tracking and make the addition of actuated shroud structures necessary for efficient turbo machine operation.

The maintenance of desirable rotor-to-stator dimensional clearances is therefore complicated by transient thermal responses and the attendant transient dimension changes possible during engine operation—in response to changes in engine fuel feed, engine load, or even engine environmental exposure—environmental in this sense including g forces, altitude and of course, temperature factors. Most turbo machine designs of the engine type therefore require consideration and accommodation of transient conditions in order to avoid intervals of rotor-to-stator rubbing during worst case operation.

Rotor-to-stator clearance behavior is also important in turbo machines other than the aircraft let engine—in such machines as compressors, pumps, and the steam turbines employed for generation of electrical energy and for ship propulsion, for example. In these non-internal combustion turbo machines, dimensional changes, of course, occur in response to temperature change in the gaseous or liquid fluid being processed as well as in response to environmental conditions. Usually such dimensional changes are of a smaller magnitude than those encountered in the combustion environment of an engine, but they may nevertheless be of concern because of a need for closer rotor-to-stator dimensional control in response to accuracy, efficiency or other causes.

Several arrangements of movable turbomachine shroud apparatus are disclosed in prior patents; these arrangements especially include thermally-actuated and mechanically-actuated shroud structures. Patent art examples of such movable shroud apparatus include the invention of J. S. Ingleson, shown in U.S. Pat. No. 3,085,398, wherein engine shroud elements are attached to a radially deformable support ring. The Ingleson support ring is distorted or oil-canned in the radial direction by a plurality of circumferentially engaged ramp members having engaged ramp surfaces that are displaced with respect to each other by a control mechanism in order to change the shroud radius. The Ingleson apparatus is therefore a mechanical shroud positioning arrangement but also contemplates the use of hydraulic actuators for changing the shroud cam position.

Another form of shroud actuation is shown in the patent of K. J. Albert et al, U.S. Pat. No. 3,391,904, which discloses a shroud arrangement wherein the wear strip that closely surrounds the rotating turbine blade periphery is mounted on a movable piston-like structure in order that the radius of the wear strip be responsive to the heat transfer into and out of the wear strip structure. The Albert et al invention uses bleed air from the compressor of the turbo machine to move the wear strip piston and controls this movement by way of carefully-selected heat transfer to the compressor bleed airflow. In the Albert et al apparatus the wear strip position is made an analog function of heat flow into and out of the wear strip supporting structure, in accordance with conventional practice in turbo machine shroud dimensional control. Transient conditions of engine operation can, however, lead to shroud positioning problems in the Albert apparatus: therefore the usual designer's dilemma of poor engine efficiency as a result of excessive clearance or incurring risk of rotor blade-to-wearstrip member collision during some conditions of engine operation remains.

Another arrangement for shroud-to-rotor clearance adjustment is shown in the patent of William R. Patterson, U.S. Pat. No. 3,966,354, which concerns an apparatus for supplying air selected from a varying combination of two sources, one of high temperature and the other of lower temperature, in order to achieve a desired mixture temperature and thereby the appropriate physical size for shroud mounting elements. The Patterson invention contemplates use of materials having high and low coefficients of thermal expansion and the use of a temperature-responsive cylinder member composed of the high thermal coefficient of expansion material for selecting between the different temperatured sources of air. The Patterson apparatus is especially concerned with the, rotor-to-stator clearances during transient conditions of engine operation, such as a throttle chop and a hot rotor burst.

Another rotor-to-stator or shroud clearance control arrangement is shown in the patent of Claude Christian Hallinger et al. U.S. Pat. No. 3,975,901. The Hallinger patent also discloses an apparatus providing the selection of stator dimension controlling air from sources supplying air at two different temperatures. The Hallinger et al invention employs an air control valve called an obturator that is responsive to the temperature of the fluid passing through the turbine for selecting relative quantities of hot and cold air for mixing. The mixed air is applied to the wall of the turbine stator to achieve stator dimension control and rotor-to-stator clearance control. The Hallinger et al invention employs the thermal expansion of an otherwise rigidly-mounted stator member for achieving the rotor-to-stator clearance control.

Yet another arrangement for turbo machine rotor-to-stator clearance control is shown in the patent of John Jenkinson, U.S. Pat. No. 3,982,850, and involves stator element positioning through thermal expansion of insulation-surrounded stator support components. The insulation used for the stator support components in the Jenkinson invention is comprised of a metallic sheet which is dimpled and spot-welded to the dimension control elements at predetermined selected intervals in order to provide a desired degree of heat conduction between insulation and the temperature-controlled component. The Jenkinson invention is based on the concept, therefore, of determining seal clearances by matched thermal expansion of seal-carrying components during varying conditions of turbo machine operation. The number and sizes of the areas of attachment between insulating sheet and the expansion control member are selected to define the required heat-conducting path into the expansion control element of the Jenkinson invention.

Yet another clearance control arrangement and a discussion of several additional of such arrangements is shown in the patent of Glen W. Thebert, U.S. Pat. No. 4,247,247 which also concerns a fluid pressure operated clearance control apparatus. The Thebert apparatus achieves blade tip clearance control by deflecting or deforming a portion of the engine housing using several sequential pressure chambers. Temperature sensing and tachometer sensing of engine operating conditions is also employed in the Thebert invention.

Although each of these clearance control arrangements is a useful advancement of the turbo machine art, none has achieved a fully satisfactory arrangement for controlling rotor-to-stator clearances under the varying conditions of operation encountered by such equipment. Most of these arrangements fail to provide the desired minimum clearance because it is difficult to exactly match the rotor time constant with the stator time constant—even with active or passive thermal methods. The present invention provides extremely fast actuation time relative to the rotor and stator thermal response time, and thereby solves this problem.

SUMMARY OF THE INVENTION

The present invention provides for the use of step function correction of rotor-to-stator clearance in a turbo machine. The provided step function can be employed concurrently with other rotor-to-stator control apparatus as a supplement or correction for the already achieved clearance. The invention employs a fluid pressure-controlled shroud positioning apparatus wherein pressurized fluid acts on a piston-like member supporting the stator shroud structure.

An object of the invention, therefore, is to provide a turbo machine rotor-to-stator clearance control that is actuated by pressurized fluid.

Another object of the invention is to provide a turbo machine clearance control that is operable from the relatively low fluid pressures available in an engine turbo machine.

Another object of the invention is to provide a turbo machine rotor-to-stator clearance control capable of supplementing other clearance control arrangements in order to achieve better turbo machine performance.

Another object of the invention is to provide a turbo machine rotor-to-stator clearance control which enables simplification of the complex heat and coolant air delivery often required in thermally-controlled clearance systems.

Another object of the invention is to provide a clearance control arrangement which alleviates problems of expansion element material selection often encountered in thermally-responsive clearance control arrangements.

Another object of the invention is to provide a clearance control arrangement which can be considered as an alternative for active thermal clearance control arrangements.

Another object of the invention is to provide a stator clearance control arrangement which enables static individual position adjustment of stator clearance elements in lieu of the precision or matched set selection of such elements commonly employed.

Another object of the invention is to provide a clearance control arrangement which accommodates the effects of stackup and maneuver loading of the clearance control apparatus.

Another object of the invention is to provide a clearance control arrangement which is free of the correction time limitations often encountered in a thermally-responsive clearance control.

Another object of the invention is to provide a clearance control arrangement which combines the capability for initial static clearance adjustment and dynamic clearance control in a single, simple mechanism.

Additional objects and features of the invention will be understood from the following description and the accompanying drawings.

These and other advantages of the invention can be achieved in a jet engine having an air compressor stage, a fuel supply system and a fuel combustion products energized bladed turbine stage, wherein rotor-to-stator shroud running clearance is controlled by the steps of segmenting the rotor facing surface of the shroud to enable expansive radial movement thereof with respect to the blade ends of the turbine, actuating the shroud segment surfaces from an annularly disposed, radially expansible chamber having actuation surface areas selected according to the force required in radially moving the shroud surfaces inward against engine flow pressures, inflating the expansible chamber thereby moving the shroud segmented surfaces inward toward the blade ends using pressurized bleed air from the engine compressor stage, controlling inflation movement of the expansible chamber and shroud surfaces between the first short radius (small rotor clearance) and second larger radius (large rotor clearance) positions in response to a predetermined algorithm for averting blade end-to-shroud segment surface pinch point rubbing.

DETAILED DESCRIPTION

Figure 1:
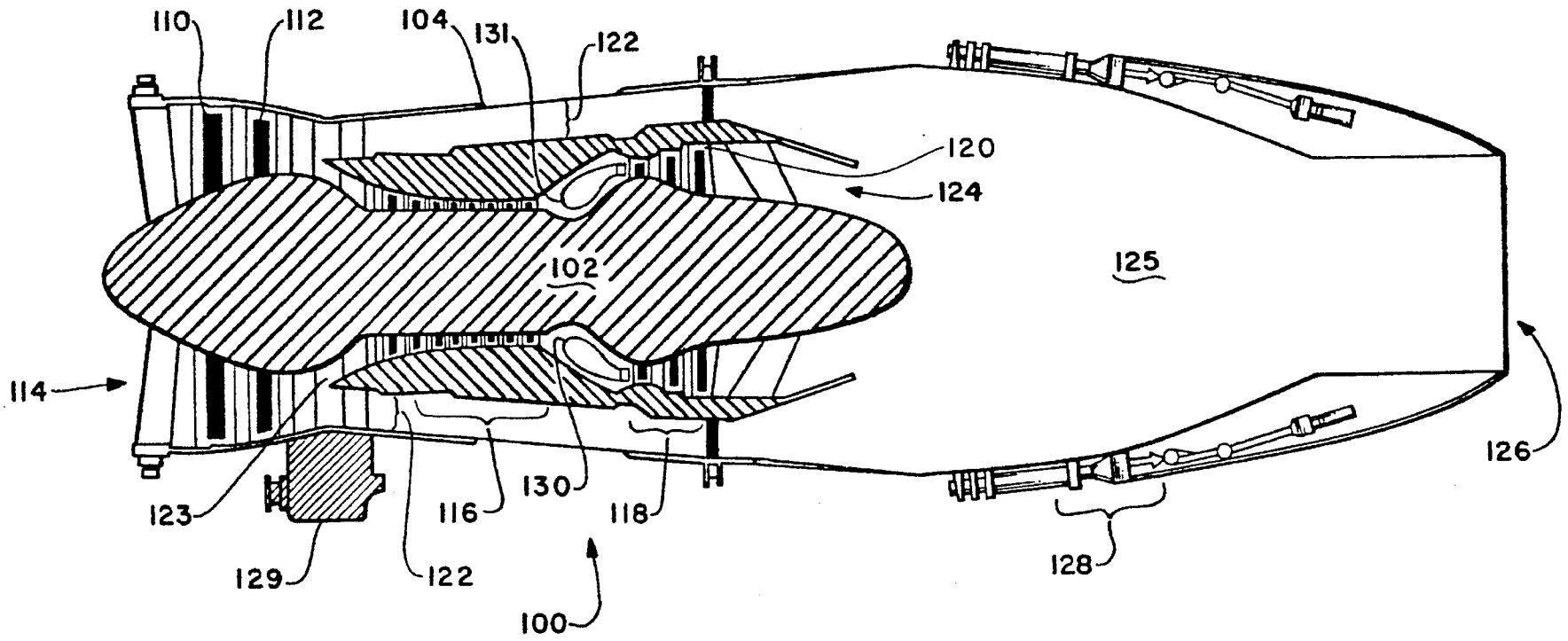
FIG. 1 is a fan let engine example of a turbo machine which might employ a fast acting dynamic clearance control according to the present invention.

In FIG. 1 of the drawings there is shown a simplified cross-sectional view of a turbo machine of the ducted turbofan aircraft engine type, an engine of the type commonly used in commercial and military aircraft. The engine assembly 100 in FIG. 1 includes housing 104, a core engine 102 of the jet type, and a pair of bladed fans 110 and 112 which are driven by the core engine 102. The core engine 102 includes a plurality of compressor stages 116, combustion chambers 130 and 131, and hot gas-driven turbine stages 118 which may be one or more in number.

During operation of the engine assembly 100 a portion of the inlet air received at the front opening 114 is captured by the inlet aperture 123 of the core engine 102 and raised in pressure by the compressor stages 116, mixed with fuel and heated by fuel combustion in the chambers 130 and 131. The heated mixture of air and combustion products passes through the turbine stages 118 and the core engine rear aperture 124 into the plenum 125 and is subsequently exhausted along with bypass air from the fans 110 and 112 at the exhaust port 126. The portion of the inlet air received through the frontal opening 114 and not captured by the core engine inlet aperture 123 bypasses around the core engine 102 in an annular space 122 which surrounds the core engine. The mixture of bypass air flowing in the annular space 122 and the core engine combustion products in passing from the exhaust port 126 at high velocity produces thrust which is, of course, usable in powering an aircraft. Other turbo machine arrangements can be used for electrical power generation, as water or liquid excited prime movers, as fluid measuring devices, and for other useful purposes known in the art.

The FIG. 1 engine assembly includes the fan duct or housing 104 which both contains the air from the fans 110 and 112 and also serves as a mounting support for the engine and for engine portions such as the fuel supply and control package indicated generally at 129. Engines of the FIG. 1 type also frequently include a thrust reversal, afterburner and exhaust port diameter controlling apparatus, as is generally indicated at 128 in FIG. 1.

In each of the fan areas of the engine assembly 100, that is, at the bypass fans 110 and 112, the compressor stages 116 and the turbine stages 118 it is desirable to obtain the highest operating efficiency and the lowest amount of fluid leakage around the periphery of the fan blades as is practically attainable. The maintenance of rotor blade to surrounding housing clearances in the order of twenty thousandths of an inch (0.02 inch) as is desirable for reasonable engine efficiency in a large assembly such as the FIG. 1 engine which has an overall diameter as large as 15 to one hundred inches can be appreciated, however, to be a significant task. This task is of some complexity for the fans 110 and 112 and the compressor stages 116 but is of considerable additional complexity for the high temperature operating turbine stages 118. The maintenance of desired clearance, around the high temperature turbine, the clearance indicated at 120 in FIG. 1 for example, is complicated by effects such as thermal expansion of engine elements with the temperatures of combustion. Additional factors such as dimensional change from centrifugal force loading and g force loading during flight maneuvers, rotating element bearing running clearances, parts assembly tolerance stackup, and engine element structural deflection from air loading can also be appreciated to enter upon the desired maintenance of close or rotor-to-stator clearances in the engine assembly 100.

Even though a variety of clearance control arrangements have been devised as is evidenced by the above-identified patent art, there is found to exist in practice a number of fundamental limitation factors which prevent the achieved rotor-to-stator clearance from being fully satisfactory. These limitations in present methods of controlling rotor blade-to-shroud clearances include time of response considerations in the positioning of engine elements, the complexity of employed element heating and cooling arrangements, and the limited availability of suitable dimension varying materials. The apparatus shown in the above identified Hallinger et al and Patterson patents notably suggest the complexity attending such arrangements.

The present invention therefore offers a simple and effective arrangement for fast acting rotor blade-to-shroud clearance control which can be used along with these currently employed methods of clearance control as a supplement and performance improving addition. In such use it can enable additional clearance reduction and the attending turbo machine efficiency improvement. The invention apparatus additionally, in some turbo machine embodiments, can eliminate the need for other forms of thermal clearance control and their inherent complexity. An alternate embodiment of the invention also provides an adjustment capability wherein individual segments of a stator shroud assembly can be statically positioned to close tolerances and furthermore can be arranged to provide non-symmetric clearances around the circumference of the rotor blade ends—as may be desirable where an engine assembly is subjected to different horizontal and vertical g force loading.

Figure 2:
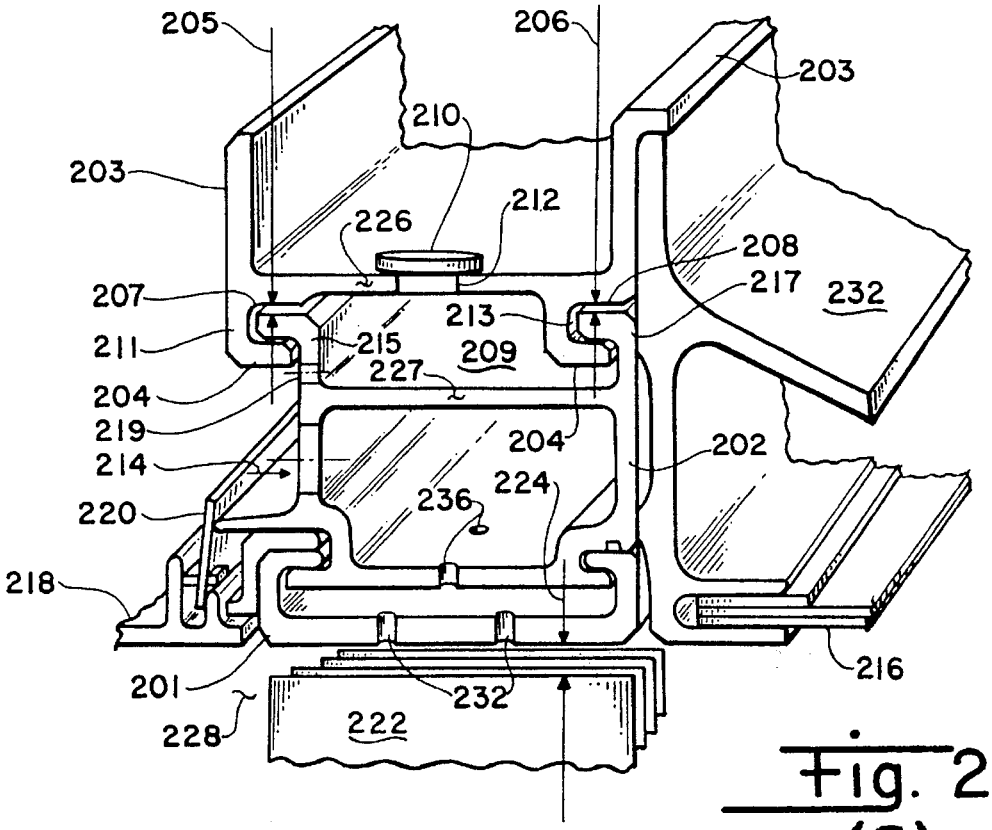
FIG. 2 is a cross-sectional perspective view of a portion of a jet engine turbo machine including apparatus according to the invention.

FIG. 2 in the drawings therefore shows a cross-sectional perspective view of elements from an engine of the FIG. 1 type or another type, a view taken just after the combustor and turbine nozzle portions of the engine and in the lengthwise vicinity of the first hot gas-driven turbine stages 118 in FIG. 1. The FIG. 2 illustrated structure is contemplated to extend circumferentially around the engine at the periphery of the first turbine stage rotor blades, and to comprise a portion of the turbine case—a portion capable of dynamically controlling the rotor-to-stator radial clearance in this first turbine stage.

The FIG. 2 apparatus includes a shroud segment or rub strip 201 which is carried on a shroud holder 202. The shroud holder 202 is in turn retained by a support structure 203. The shroud segment or rub strip 201 is presumed to be circumferentially segmented in nature, an arrangement shown, for example, in the above-referenced patent of K. J. Albert et al, U.S. Pat. No. 3,391,904, and also shown in the FIG. 5 drawing herein. The shroud holder 202 is similarly intended to be segmented in nature, while the support structure 203 may be either segmented for fabrication convenience or if desired, of a one-piece nature that circumferentially surrounds the rotor and rotor blade assembly of the FIG. 1 turbo machine. The shroud holder 202 is retained in engagement with the support structure 203 by a pair of rails 204. The shroud segment moving distance in maintaining desired clearances is set by the rail gaps 205 and 206—the holder 202 rests against the rails 204 or against the surfaces 207 and 208 in its primary and secondary positions, respectively.

The shroud holder 202 and the support structure 203 in FIG. 2 mate with a double-walled aft portion of the turbine case that is represented by the flanges 232 and 216 in FIG. 2. A forward portion of the turbine case, a portion communicating with the combustor turbine nozzle is shown at 218 in FIG. 2. An annularly-disposed seal 220 is shown to be located between the case portion 218 and an extension of the shroud holder 202 in FIG. 2, and serves to prevent leakage of flow path pressure gases from the turbine cavity 228.

A blade or bucket of the first turbine stage is shown at 222 in FIG. 2 and the clearance between this blade and the shroud segment or rub strip 201, the clearance to be controlled in the present invention, is indicated at 224 in FIG. 2. In the steady state operation or primary position of the shroud holder 202 shown in FIG. 2, the clearance 224 is shown in a lower or smaller size than is the similar clearance 324 in FIG. 3 of the drawings. The limits of motion of the shroud holder 202 are as indicated above, determined by the travel of the shroud ears 215 and 217 in the circumferential cavities 211 and 213. The large diameter, secondary or large clearance position of the shroud holder is therefore determined by seating of the ears 215 and 217 against the circumferential surfaces 207 and 208 in FIG. 2, thereby closing the gaps 205 and 206 and opening the similar but oppositely located gaps 305 and 306 shown in FIG. 3.

The FIG. 2 structure also includes an enclosed annular cavity 209 which is largely defined by the annular webs 226 and 227 and which includes a fluid inlet port 219 and a fluid exhaust port 212. The exhaust port is selectively closable by a valve member 210 that can be actuated by an apparatus which is not shown in FIG. 2 to block the escape of pressurized fluid from the annular cavity 209.

Figure 3:
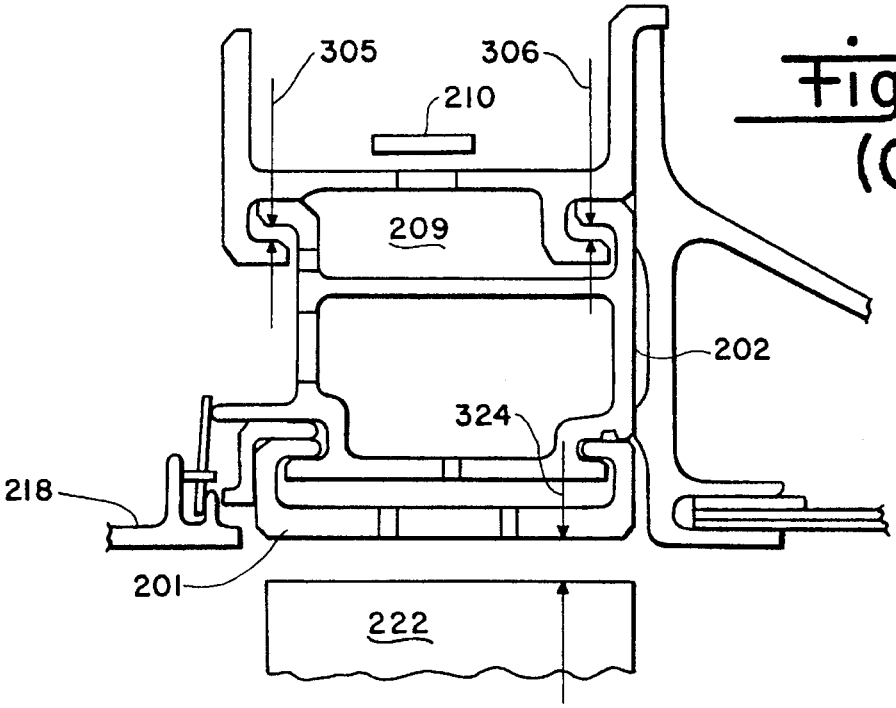
FIG. 3 shows the elements of FIG. 2 in an alternate actuation position.

Actuation of the FIG. 2 apparatus into the condition shown in FIG. 3, a condition of increased rotor blade tip to shroud clearance therefore involves the use of pressurized fluid such as air in the annular cavity 209 to move the shroud holder 202 and the shroud segment or rub strip 201 from the retracted or large radius position shown in FIG. 3 of the drawings to the primary or small-radius position shown in FIG. 2 of the drawings. Operation of the FIG. 2 apparatus therefore contemplates that fluid supplied through the inlet port 219 and trapped in the cavity 209 during the FIG. 2 closed condition of the valve 210 and other similarly disposed valves will urge the shroud holder 202 into the small radius position illustrated in FIG. 2 notwithstanding the flowpath pressure of the fluid in the turbine cavity 228. Alternately, of course, pressurization and release of the cavity 209 can both be accomplished through the port 219 or the source of pressurized fluid interrupted rather than opening the valve 210 to depressurize the cavity 209. Suitable pressure control arrangements for the cavity 209 are, of course, known in the art.

The small radius or primary condition of the shroud holder 202 is therefore preferably achieved by supplying fluid of a higher pressure to the cavity 209 in comparison with the combustion gas flow path pressure in the turbine cavity 228. Preferably, this higher-pressure fluid in the case of a jet engine turbo machine, is derived from the compressor stages, 116 in the engine of FIG. 1, in order to avoid the complexity of special purpose blowers or pumps for achieving movement of the shroud holder 202. From another viewpoint therefore, it can be stated that the areas of the circumferential webs 226 and 227 in FIG. 2 are preferably arranged with respect to the fluid pressures existing in the turbo machine, as to make movement of the shroud holder 202 feasible with the use of compressor discharge pressure air. For arranging the FIG. 2 apparatus to achieve this desirable feature, it is, of course, possible to select the axial widths of the web members 226 and 227 with respect to the axial width of the shroud segment 201 within some constraints.

In an example jet engine, flow path pressures in the cavity 228 in the range of 150 psi are typical while compressor discharge pressures, pressure in the cavity 209, can be expected to be in the range of 200 psi and pressures outside the valve 210 can be expected in the range of 50 psi. These pressures are clearly of a magnitude enabling the similar axial lengths of the cavity 209 and the shroud segments 201 etc. in order to achieve reliable actuation of the shroud holder 202 between the FIG. 3 and FIG. 2 positions upon closure of the valve 210. Other engines can be expected to have similar pressure relations.

The FIG. 2 apparatus also includes a secondary fluid inlet port 214 which can be used to circulate cooling fluid through the shroud holder and shroud segment assembly in order to maintain desirable operating temperatures in these elements. Outlet for the fluid received through the port 214 may be through impingement holes shown typically at 236 in the shroud holder 202 and through cooling holes shown typically at 237 in the shroud segments 201, as is known in the art. Pressurized air from an engine compressor stage is once again a preferred source of this cooling fluid.

According to a preferred arrangement of the invention, pressurized fluid movement of the shroud holder 202 is to be used as a supplement to a thermally responsive or other clearance control arrangements which may be employed in connection with the FIG. 2 apparatus. According to this concept therefore, the FIG. 2 apparatus can be used to increase the rotor-to-stator clearance whenever needed to alleviate expected or commenced rotor-to-stator shroud collision rubbing, and furthermore may be employed during either transient or long-term rubbing periods. The capability for a fast response, a response within one to two seconds or less than three seconds is, however, an especially desirable feature of the FIG. 2 apparatus.

It should be recognized also that the FIG. 2 described elements or some portion of these elements may already be position controlled with respect to the center line of the engine rotor and the rotor blade ends; the described pressurized fluid or pneumatic movement of the shroud holder 202 is, in such an arrangement, used as a binary or two-position supplement to the existing clearance compensating apparatus. The existing clearance compensation apparatus may of course include response to engine element temperatures, fluid flow rates in the cavity 228, throttle position indicating signals, and other algorithms for predicting clearance changes and the onset of a rotor blade-to-stator shroud collision rubbing condition. The apparatus for responding to these algorithms may range from a simple temperature sensing length variable element to a complex servo system, but is nevertheless subject to improvement in most instances by the addition of a worst case or pinch point relieving clearance control such as the herein described pressurized fluid actuated apparatus. Alternately, of course, it is possible to use the FIG. 2 apparatus and the described pneumatic change of clearance 224 alone as the rotor-to-stator clearance adjustment in some turbo machine embodiments.

FIG. 3 in the drawings shows the shroud holder 202 and the shroud segment in the transient secondary or large radius position, as is indicated by the space gaps 305 and 306 which are in lieu of the gaps 205 and 206 in FIG. 2. The alternate position of the shroud holder 202 is also indicated by the larger rotor blade-to-stator shroud segment clearance shown at 324 in FIG. 3. For the sake of drawing simplicity, only the cross-sectional face of the FIG. 2 apparatus is shown in FIG. 3, the oblique or perspective nature of these elements being understood from the FIG. 2 drawing. The presence of additional rotor blades in the FIG. 2 drawing and the absence of these blades in FIG. 3 somewhat obscures the perceived different rotor blade-to-stator shroud segment clearances in FIG. 2 and FIG. 3, however, the intended concept is believed understood from the description herein. The valve 210 is shown in the open position in FIG. 3, indicating the absence of increased pressure in the cavity 209, as is consistent with the retracted position of the shroud holder 202 in the presence of the gaps 305 and 306.

One aspect of the invention therefore involves the use of a blade clearance shroud arrangement wherein the relative areas of the shroud elements that are exposed to engine flowpath pressures and the area of the shroud element mounting "piston" that is exposed to a pressurized control fluid are arranged to enable actuation of the shroud elements to different clearance positions with the use of only relatively low pressure bleed supplied, actuating fluid. In the typical engine described above the difference between engine flowpath and compressor discharge path pressures are relatively small but with the use of selected relative areas can provide the desired clearance control actuation forces.

Figure 4:
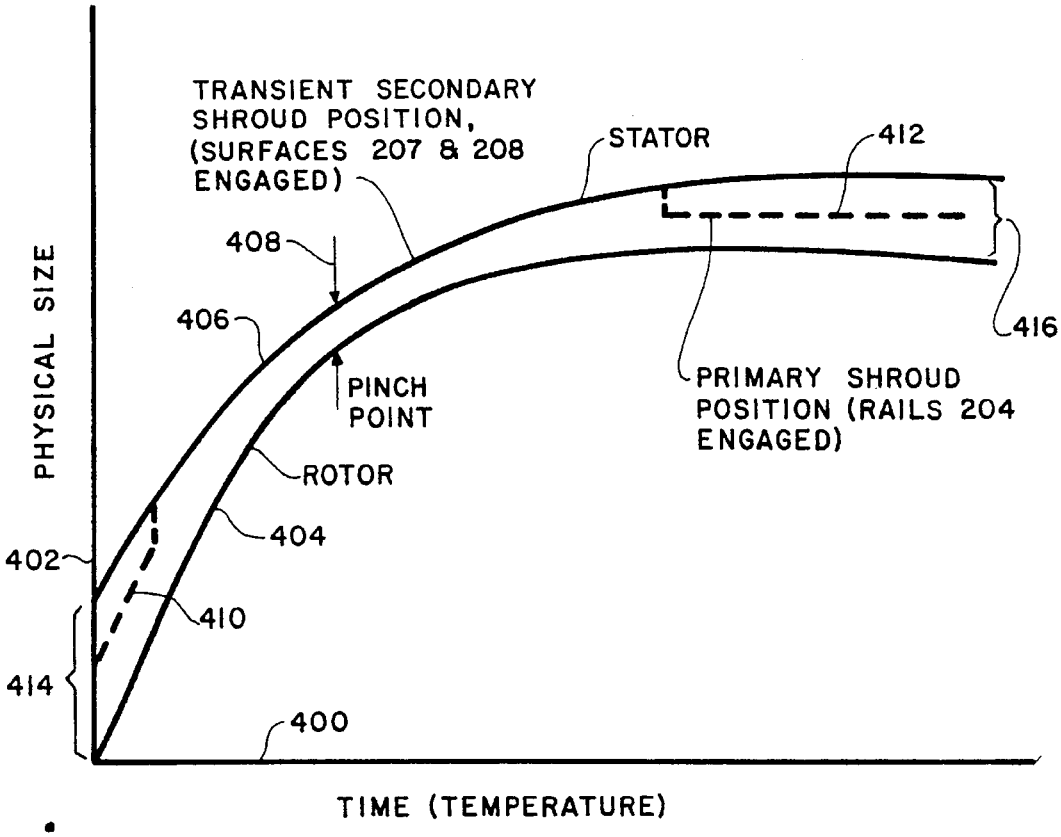
FIG. 4 is plot of engine-to-shroud clearance against a parameter such as time or temperature.

An example of conditions in which the present invention becomes useful is shown in the graphical relationships of FIG. 4 in the drawings. In FIG. 4, the physical sizes of the rotor and stator members of an aircraft engine turbo machine are represented by the curves 404 and 406 which are plotted on the axes of physical size 402, and time or temperature, 400. The FIG. 4 illustrated conditions are moreover representative of occurrences in an engine that is already clearance compensated—that is, such compensated clearance engines are found to undergo pinch point clearance problems. The FIG. 4 curves might represent a rapid rotor acceleration sequence for an aircraft engine and thereby indicate the response of engine components to conditions of increasing heat load. Differences in thermal mass and thermal exposure can be expected in the FIG. 4 represented conditions to result in a pinch point or condition of worst case minimal clearance between rotor and stator 408 at some time or temperature following onset of the rapid acceleration event. Similar pinch point events can be expected during throttle chop, reburst, and other expected engine operating conditions in a practical aircraft engine or other turbo machine apparatus.

As is illustrated by the relatively large rotor-to-stator spacing 414 near the initiation of the FIG. 4, the maintenance of acceptable pinch point clearance at 408 even in the presence of a thermally compensated or clearance compensated engine often is accompanied by undesirably large clearances under some expected operating conditions: these large clearances are shown at the initial conditions 414 in FIG. 4 and also in the steady-state conditions 416.

Another aspect of the present invention therefore, involves the use of apparatus such as shown in FIGS. 2 and 3 and also in FIGS. 5–9 herein, to abruptly change the rotor-to-stator clearance in a turbo machine to a desirable high efficiency value whenever such a change might be beneficial to operation of the machine. The improvement in rotor-to-stator clearance conditions achieved with step changes of shroud position is represented by the dotted lines at 410 and 412 in FIG. 4. Conditions appropriate for actuating the FIG. 2 and FIG. 3 shroud-to-rotor clearance control apparatus between its two possible endpoints and thereby initiating the clearance changes 410 and 412 can be sensed from one or a combination of engine parameters such as throttle setting, engine element temperature or pressure, or by the direct measurement of effective rotor-to-stator clearance using magnetic or optical sensor devices, or by other arrangements.

It should, of course, be understood that the FIG. 4 curves and the pinch point 408 are merely illustrative of conditions which may occur in a turbo machine, especially during operating transients of the machine and that a rotor-to-stator clearance pinch point located in different relative positions or occurring only during deceleration or acceleration of the turbo machine are within the purview of the invention. Each of the above identified six prior patents includes discussion of rotor-to-stator clearance conditions and the changes occurring in this clearance during throttle chop, engine startup, and other expected operating conditions. The disclosure of these six prior patents is therefore hereby incorporated by reference into the present specification.

It should also be understood that with incorporation of the present invention clearance control apparatus it may be desirable to deliberatly arrange turbo machine clearances in a manner which will predictably result in rotor-to-stator rubbing collision in order to achieve the better operating efficiency thereby afforded and then to relieve this expected collision through operation of the present invention apparatus. The manner of employing and actuating the present invention apparatus is therefore dependent upon the clearance behavior and transient responses observed in the turbo machine under consideration and possibly also on the type of clearance change sensor employed.

Figure 5:
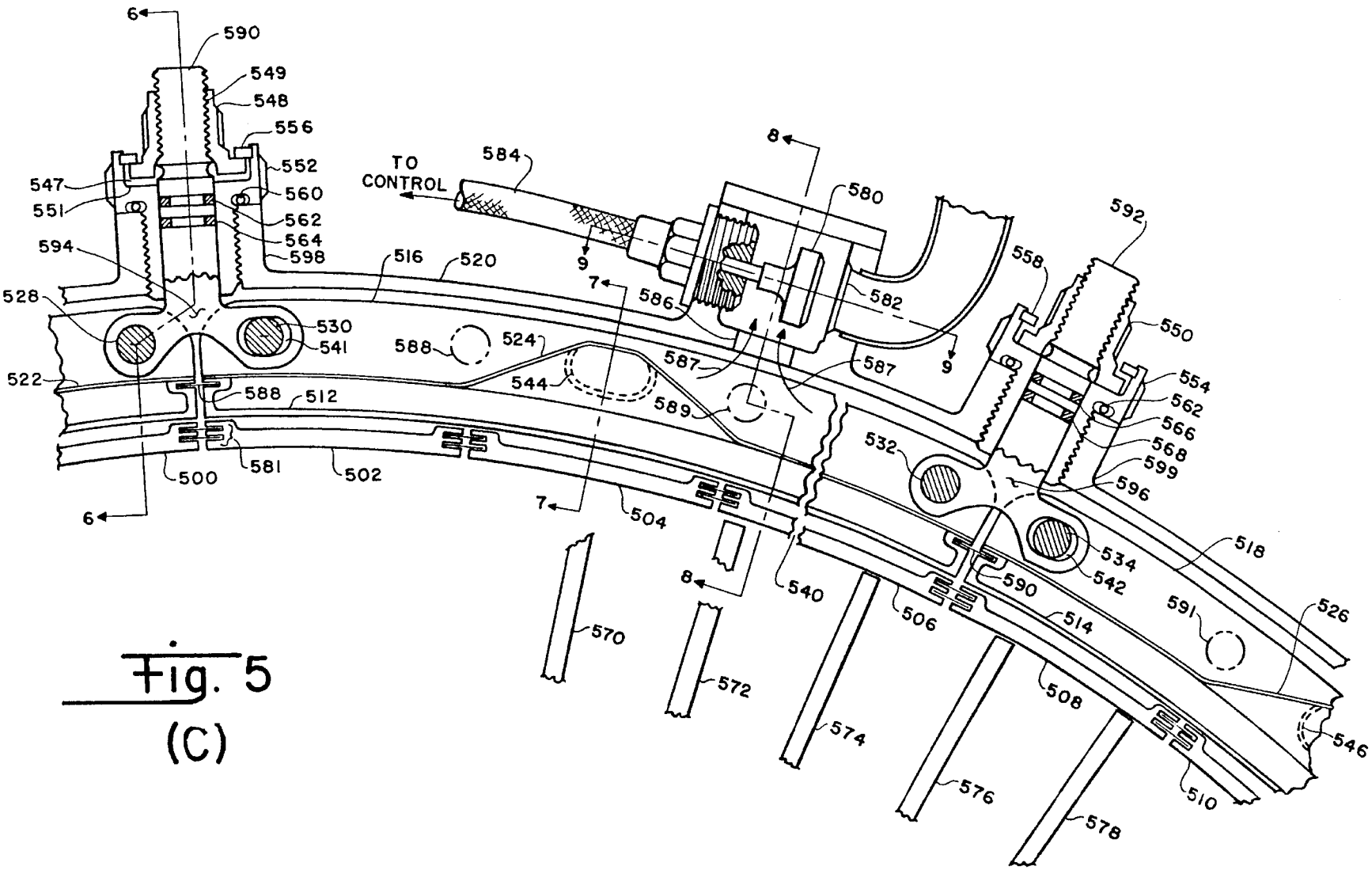
FIG. 5 is an alternate cross-sectional view of apparatus in accordance with the invention.
Figure 8:
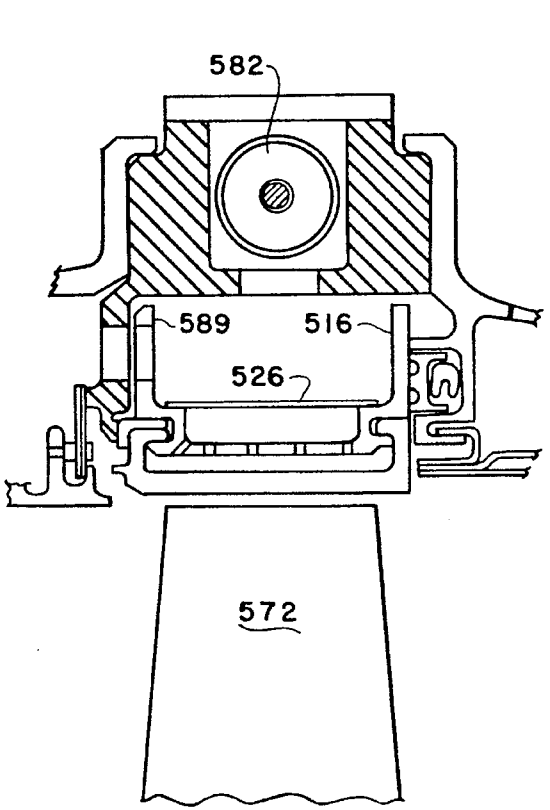
FIG. 8 is another cross-sectional view taken from the FIG. 5 apparatus.
Figure 7:
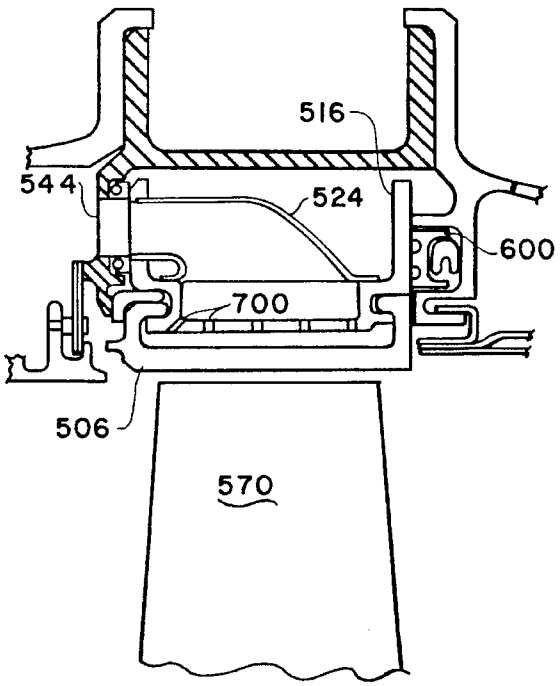
FIG. 7 is a second cross-sectional view taken from the FIG. 5 apparatus.

An alternate arrangement of the present invention is shown in FIGS. 5–9 of the drawings. The apparatus shown in FIG. 5 comprises a circumferential segment of a let engine turbine stage which is adapted to employ the clearance control of the present invention. In FIG. 5, housing 520 is shown to enclose an engine rotor which carries turbine blades 570, 572, 574, 576, and 578. Other turbine blades are of course, used in the FIG. 5 engine, but are omitted for drawing clarity. Located between the shroud casing 520 and the ends of the turbine blades 570–578 is a radially movable stator shroud apparatus which includes the array of shroud segments or rub strips 500, 502, 504, 506, 508, and 510. These shroud segments are backed by a series of shroud holder elements, two of which are shown at 512 and 514 in the FIG. 5 apparatus. The shroud holder elements are in turn supported by a circumferential ring of support members, two of which are shown at 516 and 518 in FIG. 5.

The support members in the FIG. 5 apparatus are in turn suspended from a plurality of yoked shank members 590 and 592 which are radially disposed to pass through the engine housing 520 at periodic intervals. The yoke portions of the shank members are indicated at 594 and 596, respectively. The shank members 590 and 592 are received in threaded boss members 598 and 599 which are in turn made integral with or attached to the shroud casing 520. Intermediate the shank members 590 and 592 and the boss members 598 and 599 is located a pair of externally-threaded elongated sleeve bushings 552 and 554 which engage internal threads of the boss members 598 and 599, and which include an annular cavity capable of receiving and capturing a resilient sealing member such as the O-rings 560 and 562. The shank members 590 and 592 are contemplated to slide freely in the radial direction of FIG. 5 within the bushings 552 and 554. A gas-tight seal between the shank members 590 and 592 and the bushings 552 and 554 is achieved by the captured resilient seal members 562, 564, 566, and 568 located on the shank members 590 and 592.

A pair of shouldered threaded nuts 548 and 550 are used to limit the actuation travel of the shanks 590 and 592 within the bosses 598 and 599 and the bushings 552 and 554. Annular rings 556 and 558 limit the outward travel of the shouldered nuts 548 and 550 and the shanks 590 and 592. The nuts 548 and 550 are threadably engaged with the shanks 590 and 592 as is indicated at 549 for the shank 590. The gap 547 between the nut 548 and the bushing 552 will be appreciated therefore, to determine the extent of the radial travel of the shank 590 within the bushing 552 and thereby determine the extent of the rotor-to-stator clearance adjustment for the parts attached to the shank 590. The outward-facing surface 551 of the bushing 552, together with the inner face of the spring retainer 556 therefore determine the actual limits of the actuation radial travel of the nut 548 and the shank 590 and the yoke attached parts within the shroud casing 520.

Figure 6:
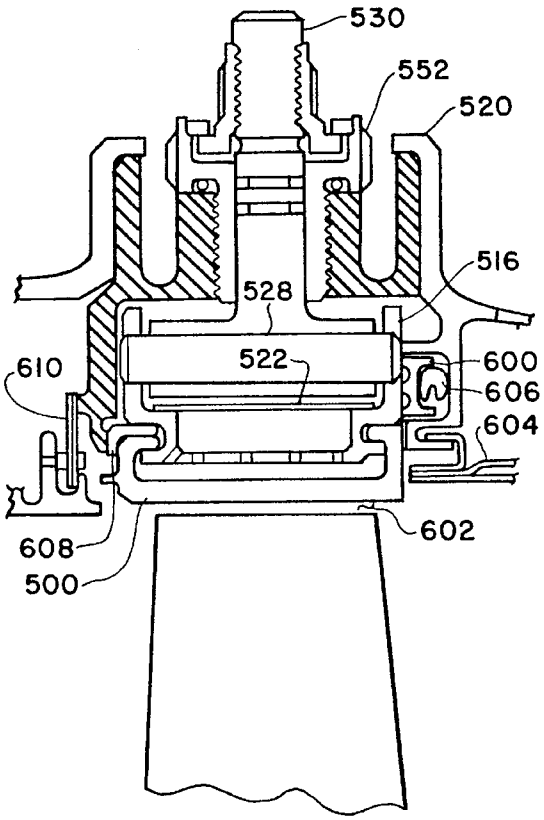
FIG. 6 is a cross-sectional view of a first portion of the FIG. 5 apparatus.

Actuation of the shanks 590 and 592 in FIG. 5 between the limits established by the surface 551 and the face of the spring 556 is preferably accomplished pneumatically and in a manner similar to that described for FIGS. 2 and 3 above. FIG. 6 of the drawings, which is taken along the curving line 6—6 in FIG. 5, shows that the support member 516 is actually arranged in the form of a piston which is radially movable within the shroud casing 520 to control the rotor blade-to-rub strip clearance gap indicated at 602 in FIG. 6. Pressurized fluid for accomplishing this pneumatic movement is supplied to the FIG. 5 apparatus through a series of ports shown typically at 588, 589, and 591 in FIG. 5 and also at 589 in FIG. 8, a view taken along the cutting line 8—8 in FIG. 5. Preferably, the pressurized fluid supplied to the ports 588, 589, and 591 originates in the compressor stage of the engine.

Figure 9:
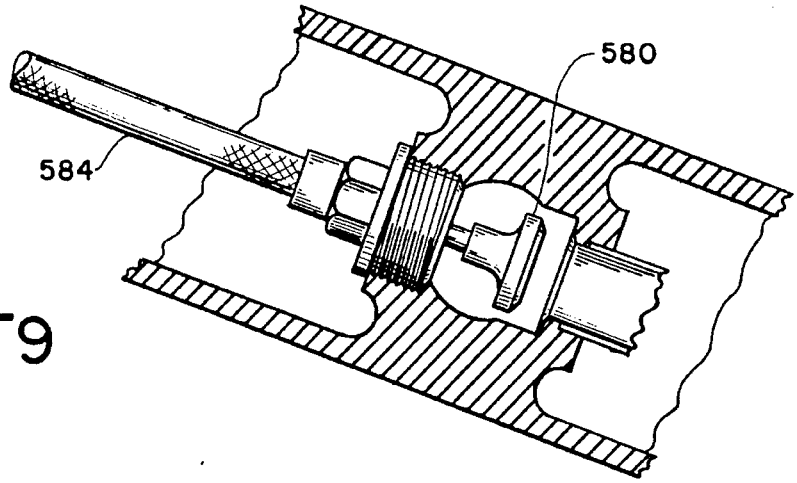
FIG. 9 is an additional cross-sectional view taken from the FIG. 5 apparatus.

The pressure applied to the surfaces of the support member 516, that is, the pressure tending to move the rub strips 500–510 radially inward, is preferably controlled with the use of a valve member which is indicated at 580 in FIG. 5. Closure of the valve member 580 against the aperture 582 therefore causes pressure within the support member 516 to build up to a degree causing radially inward movement of the support member, the shroud holders 512, 514, and the rub strips 500–510. Pressurized fluid from the chamber communicates with the valve 580 by way of the aperture 586 as is indicated by the flow arrows 587 therein. Actuation of the valve 580 can be controlled by way of the flexible cable 584 in response to the sensing of pinch point onset, as described earlier herein. Additional details of the valve 580, the escape aperture 582 and the control cable 584 and their interrelationship with mounting structure is shown in FIG. 9 of the drawings; FIG. 9 being taken along the cutting line 909 in FIG. 5.

The bushings 552 and 554 are used in the FIG. 5 apparatus to provide circumferential clearance within the interior of the boss members 598 and 599 that will allow assembly of the FIG. 5 apparatus—that is, to permit loose non-radial positioning of the shank members within the interior of the boss members 598 and 599—prior to the radially outward movement of the shank members and the structure supported thereon into the FIG. 5 illustrated position. Without the removable bushings 552 and 554 radial movement of the assembled shanks and structure supported thereon would not be possible during assembly.

The threaded and shouldered nuts 548 and 550 in FIG. 5 allow precise static positioning of the shroud segments 500–510 with respect to the rotor blade ends, positioning is adjusted to within a few thousandths of an inch in order to achieve maximum possible engine operating efficiency. It is furthermore especially notable that the nuts 548 and 550 allow a non-symmetric static positioning of the shroud segments with respect to the blade ends around the periphery of the rotor blades. Non-symmetric shroud to blade clearances are frequently desired when an engine is designed for greater g force loading along one coordinate axis, e.g., an allowance for hard landings of an aircraft.

Certain additional details of the alternately arranged apparatus of the present invention are also viewable in FIG. 5. These additional details include the plurality of circumferentially flexible gas seals located between the rub strip ends and shown typically at 581 in FIG. 5. The circumferential flexibility of the seals 581, of course, accommodates the different circumferences of the rub strips 500–510 in the different radial positions thereof. Also shown in FIG. 5 are the circular pin members 528, 530, 532, and 534 which are received in the yoke portions 594 and 596. As indicated at 541 and 542 in FIG. 5, one pin receptacle of each yoke is preferably provided with some circumferential clearance or play in order to also accommodate the differing circumferences of the support members 516 and 518 in their respective positions. The break line 540 in FIG. 5 accommodates the outward and inward positions of the shank members 590 and 592 and the differing positions of the attached elements.

Also shown in FIG. 5 and FIGS. 6, 7 and 8 of the drawings are cooling air supply apertures 544 and 546 and an array of cooling air baffles 522, 524, and 526 which supply pressurized cooling air to the rub strip array members 500–510, and to the other parts of the clearance control apparatus. A series of holes indicated at 700 in FIG. 7 serve to admit this pressurized cooling air to the rear side of the rub strip or shroud segments, as is illustrated also in FIG. 7.

Further additional details of the FIG. 5 apparatus are also shown in FIGS. 6, 7, 8 and 9 of the drawings. These additional details include the flexible seal member 600 and its backing spring 606 which serve to impede the flow of gases from within the engine flow path to the lower outside ambient pressure, and the similarly functioning seal member 608 which is located on the opposite side of the piston-like support member 516. Also shown in FIG. 6 is the interface of the shroud casing 520 with the engine housing 604 and the annularly disposed seal member 610. The FIG. 7 view of the FIG. 5 apparatus includes one of the FIG. 5 illustrated turbine blades 570 and the cooling air aperture 544. The FIG. 8 view of the FIG. 5 apparatus includes the cooling air baffle 526, a portion of valve 580 shown at 582, and the aperture 589 which admits pressurized air for movement of the support member 516.

One aspect of the present invention therefore concerns the provision of an arrangement wherein a large area "piston", the illustrated shroud or rub strip holder assembly, can be provided in order that relatively low pressure air available from the compressor stage of an aircraft engine or other turbo machine apparatus be capable of moving rub strip members into desirable rotor clearance positions—notwithstanding the presence of engine internal pressures opposing such movement. This arrangement is especially advantageous when compared with prior art rotor-stator clearance control arrangements wherein hydraulic pistons or similar devices were employed to achieve clearance control—an arrangement which required the use of hydraulic pumps, hydraulic fluids, and other undesirable complexities. The second embodiment of the invention shown herein also provides a desirable arrangement for statically adjusting the rotor-to-stator clearances in a turbo machine, and is especially useful in the case of aircraft engine turbo machines wherein both close and accurately controlled clearances are desirable and wherein non-symmetric values of clearance are employed at different points around the periphery of the rotor blades in order to accommodate the expected different distortions of engine components from differing g force loads in the vertical and horizontal planes. The invention furthermore offers flexibility as to the overall control of rotor-to-stator clearances since it can be readily adapted to be supplemental to a thermally actuated, or analog, or normally provided rotor-to-clearance control arrangement. The signal used to control movement of the presently described clearance control apparatus between its two actuation positions can be readily derived from any one of or a combination of engine operating parameters such as temperature, pressure, actual achieved clearance values, or even the actual incidence of rotor-to-stator rubbing collision.

While the apparatus and method herein described constitute a preferred embodiment of the invention, it is to be understood that the invention is not limited to this precise form of apparatus or method, and that changes may be made therein without departing from the scope of the invention, which is defined in the appended claims.

I claim:

1. A method for operating a low leakage, close radial clearance turbomachine comprising the steps of:

selecting for said turbomachine a static rotor-to-stator shroud radial clearance value selected to produce rotor-on-stator rubbing collision during worst case transient operation thereof;

determining the turbomachine transient operating conditions capable of inducing said rotor-on-stator rubbing collision;

sensing the onset of turbomachine operating conditions approaching said rotor-on-stator rubbing collision conditions;

increasing said rotor-to-stator shroud radial clearance from a first predetermined low leakage value to a second, higher leakage, collision avoidance, predetermined value for the duration of said transient rubbing collision inducing operating conditions;

returning said radial clearance to a close, predetermined low leakage value following cessation of said transient rubbing collision inducing operating conditions; and maintaining said rotor-to-stator shroud clearance in a dynamically corrected partially rubbing free condition using a predetermined analog algorithm response to turbomachine operating conditions whereby said sensing, increasing and returning sequence radial clearance is supplementary to said analog algorithm radial clearance.

2. The method of claim 1 wherein said predetermined values of clearance are determined by said analog algorithm.

3. The method of claim 1 wherein said sensing the onset step includes monitoring the operating temperature of an element in said turbomachine.

4. The method of claim 1 wherein said sensing the onset step includes monitoring the operating pressure adjacent an element in said turbomachine.

5. The method of claim 1 wherein said sensing the onset step includes monitoring the flow rate of a fluid communicating with said turbomachine.

6. The method of claim 1 wherein said selecting step includes adjusting said rotor-to-stator shroud clearance statically at segments of said stator shroud disposed around the periphery of said rotor.

7. The method of claim 6 wherein said adjusting step includes imparting differing values of rotor-to-stator shroud static radial clearance at different circumferential points around said turbomachine rotor in response to expected g force loading of said turbomachine.

8. In a jet engine having an air compressor stage, a fuel supply system and a fuel combustion products energized bladed turbine stage, the method of controlling rotor-to-stator shroud running clearance at the blade periphery of the turbine stage comprising the steps of:

segmenting the rotor facing surface of said shroud to enable expansive radial movement thereof with respect to the blade ends of said turbine;

actuating said shroud segmented surfaces from an annularly disposed radially expansible chamber having actuation surface area selected according to the force required in radially moving said shroud surfaces inward against engine flowpath pressures;

inflating said expansible chamber and moving said shroud segmented surfaces inward toward said blade ends using pressurized bleed air from said engine compressor stage; and controlling inflation movement of said expansible chamber and said shroud surfaces between first short radius small rotor clearance and second longer radius large rotor clearance positions in response to a predetermined algorithm for averting blade end to shroud segment surface pinch point rubbing.

9. The method of claim 8 wherein said controlling step also includes selectively venting said expansible chamber to a low pressure region thereby enabling outward increased rotor clearance movement of said shroud surfaces in response to said engine flow pressure.

10. Rotor-to-stator shroud radial clearance control apparatus for a low leakage close clearance turbomachine apparatus comprising:

means for sensing the onset of turbomachine operating conditions approaching rotor-on-stator rubbing collision;

means for stepwise increasing said rotor-to-stator shroud radial clearance from a first predetermined low leakage value to a second, higher leakage collision avoidance predetermined value for the duration of said rubbing collision operating conditions; and means for returning said radial clearance to a close, predetermined low leakage value following termination of said rubbing collision inducing operating conditions.

11. The apparatus of claim 10 further including means for maintaining said rotor-to-stator shroud radial clearance in a dynamically corrected partially collision rubbing free condition including a predetermined algorithm responsive to turbomachine operating conditions.

12. The apparatus of claim 10 wherein said means for stepwise increasing is fluid pressure actuated.

13. The apparatus of claim 10 wherein said turbomachine is a jet engine and wherein said operating conditions approaching rotor-on-stator rubbing collision include transient thermal conditions responsive to engine power setting changes.

14. The apparatus of claim 13 wherein said fluid pressure is comprised of fluid pressurized in the course of normal operation of said turbomachine.

15. The apparatus of claim 14 wherein said means for stepwise increasing includes a pressurized fluid expansible chamber member disposed surrounding a substantial portion of a rotor member in said turbomachine.

16. The apparatus of claim 15 wherein said stator shroud member is disposed intermediate said rotor member and said expansible chamber member.

17. The apparatus of claim 15 wherein said turbomachine is a jet aircraft engine and said pressurized fluid is compressor discharge pressure air from the compressor stage of said jet engine.

18. The apparatus of claim 17 wherein said expansible chamber member includes an actuation surface area size selected in accordance with the force required to move said shroud inward toward said rotor member against engine combustion flow pressure.

19. The apparatus of claim 18 wherein said means for returning includes release means for enabling escape of said pressurized fluid from said expansible chamber member to a region of lower pressure.

20. The apparatus of claim 19 wherein said means for stepwise increasing said rotor-to-stator shroud radial clearance includes clearance limit determining elements movably responsive to said predetermined algorithm;

whereby said stepwise clearance increase is additive to said algorithm clearance maintenance.

21. The apparatus of claim 20 wherein said predetermined algorithm is an analog algorithm.

22. The apparatus of claim 21 wherein said algorithm includes a thermal response to engine operating parameters.

23. The apparatus of claim 22 wherein said clearance control shroud actuation surface area includes a length dimension, measured along the length axis of said engine, substantially equal to the axial projected component of turbine blade end length.

24. Clearance adjustment apparatus for the stator-to-bladed rotor clearance gap of an aircraft engine turbomachine comprising:

an engine housing of substantially circular cross section;

a circularly disposed azimuthally segmented rub strip assembly located within said housing surrounding said bladed rotor ends and separated therefrom by said clearance gap;

a circularly disposed azimuthally segmented rub strip support structure located between said rub strip assembly and said housing, said support structure including annularly disposed pneumatically expansible chamber means for moving said rub strip segments radially inward and outward with respect to said rotor blade ends;

a plurality of thread adjustable radially disposed shank means periodically located around said housing and support structure and connected with said housing at the outward ends thereof, said shank means being also connected at the inward ends thereof with the outward facing portion of said support structure pneumatically expansible chamber means, for statically adjusting said rub strip to blade end clearance gap in circumferential periodic segments; and means including a binary modulation control for selectably supplying ambient pressure air and pressurized air from the compressor stage of said engine to said expansible chamber means.

25. The apparatus of claim 24 wherein said shank means is comprised of shank members passing radially through said engine housing.

26. The apparatus of claim 25 wherein a thread adjustable portion of said thread adjustable shank means is located external of said engine housing.

27. The apparatus of claim 26 wherein said thread adjustable portion includes a threaded shank member.

28. The apparatus of claim 27 wherein said thread adjustable portion also includes a threaded nut member.

29. The apparatus of claim 28 wherein said thread adjustable portion includes also resilient sealing means for inhibiting the flow of pressurized fluid between the interior and exterior of said housing.

30. The apparatus of claim 28 wherein a plurality of rub strip segments of said segmented rub strip assembly are received on each segment of said segmented support structure.

31. The apparatus of claim 24 wherein said segmented rub strip assembly includes a plurality of circumferentially expansible gas seal members located circumferentially intermediate adjacent segment ends of said rub strip assembly.

32. The apparatus of claim 24 wherein said plurality of shank means is comprised of at least four shank members disposed in quadrature about said engine circumference;

whereby asymmetric static adjustment of said rotor blade end to stator rub strip clearance gap in accommodation of expected asymmetric g force loading of said engine is enabled.

33. The apparatus of claim 24 wherein the combination of said rub strip and rub strip support structure further includes engine operating condition responsive means for controlling said rotor blade end to stator rub strip clearance gap and wherein said pneumatically expansible chamber means movement of said rub strip segments is mathematically supplemental to said operating condition responsive gap clearance control.

* * * * *